United States Patent [19]

Martus

[11] Patent Number: 4,502,604

[45] Date of Patent: Mar. 5, 1985

[54] CHAMBERED BOTTLE CAP

[76] Inventor: Don Martus, 38235 Hazel Rd., Mt. Clemens, Mich. 48045

[21] Appl. No.: 520,995

[22] Filed: Aug. 8, 1983

[51] Int. Cl.[3] ..... B65D 1/04

[52] U.S. Cl. ..... 215/206; 215/364

[58] Field of Search ..... 215/6, 355, 364; 220/23; 222/454, 455; 206/219

[56] References Cited

U.S. PATENT DOCUMENTS

| | | | |
|---|---|---|---|
| 558,848 | 4/1896 | Schafer . | |
| 672,850 | 4/1901 | Jayne . | |
| 701,101 | 5/1902 | Stutz . | |
| 2,101,324 | 12/1937 | Warner . | |
| 2,101,598 | 12/1937 | Riedel . | |
| 2,266,276 | 12/1941 | Schluchter et al. . | |
| 3,057,502 | 10/1962 | Wood . | |
| 3,898,046 | 8/1975 | Ikeda et al. . | |
| 3,900,122 | 8/1975 | Dichter . | |
| 4,008,820 | 2/1977 | Ruetz . | |
| 4,089,432 | 5/1978 | Crankshaw et al. | 215/6 |
| 4,244,467 | 1/1981 | Cavazza | 215/6 |

*Primary Examiner*—George T. Hall

*Attorney, Agent, or Firm*—Gifford, VanOphem, Sheridan, Sprinkle & Nabozny

[57] ABSTRACT

A closure cap for a bottle comprising a tubular housing adapted to seal the neck of the bottle includes a chamber having one end in communication with the interior of the bottle. A displaceable plug closes the other end of the tubular housing and includes an elongated stem having a valve formed on its lower end. Further insertion of the plug closes the valve against the tapered end wall at the open end of the housing so that sediment which has settled in the chamber when the bottle is inverted becomes trapped within the cap and remains separated from the contents of the bottle.

22 Claims, 8 Drawing Figures

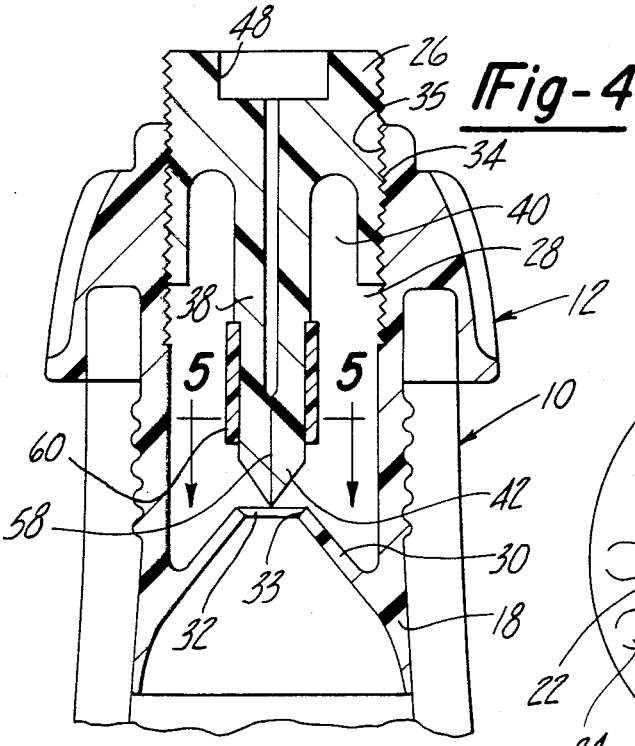
Fig-4
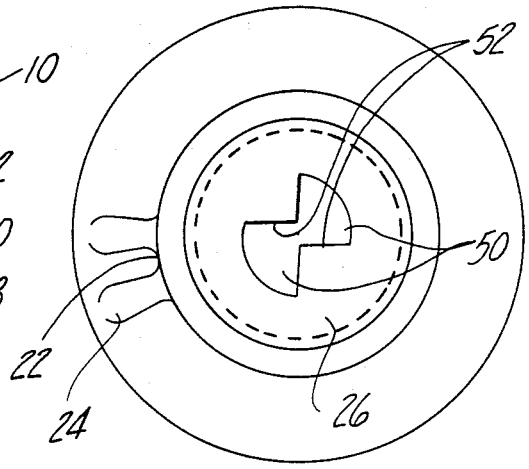
Fig-6
Fig-7
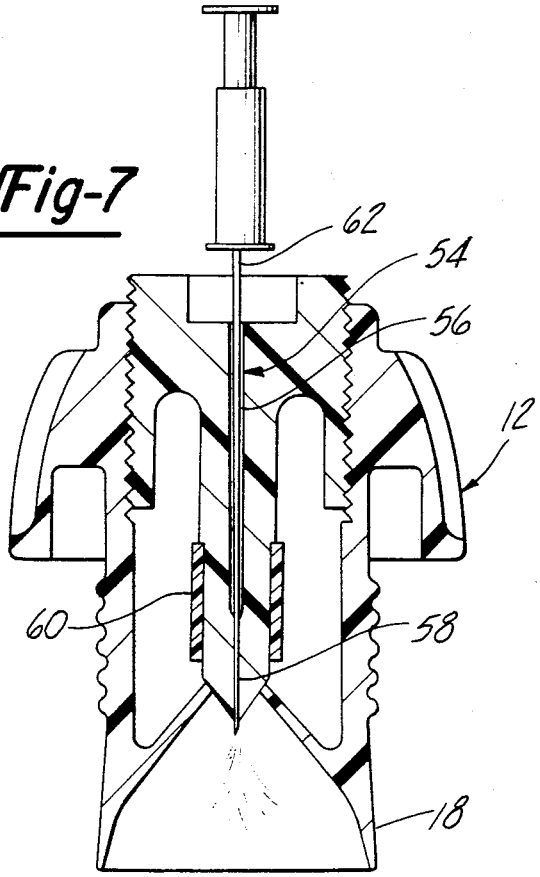
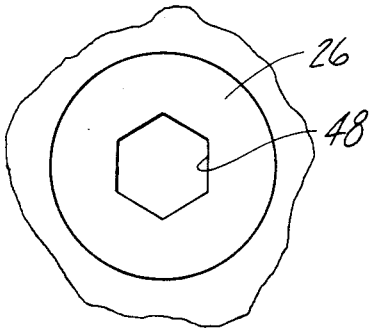
Fig-8
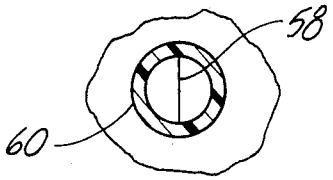
Fig-5

CHAMBERED BOTTLE CAP

BACKGROUND OF THE INVENTION

I. Field of the Invention

The present invention relates generally to closures, and more particularly to a bottle cap having a chamber with one end in fluid communication with the interior bottle and valve means for closing and opening one end of the chamber.

II. Description of the Prior Art

In the process of making wine, remnants of fruit and other food products remain intermixed with the wine product and must be removed by distillation, decanting or some other process. The removal of the solik is especially difficult with effervescent wines commonly referred to generally as champagnes. In one previously known effervescent wine making process, the charmat process, pressurized transfer equipment and pressurized fermentation tanks are used. Such equipment is very expensive and only economical to use if large commercial quantities of wine are to be produced.

Another previously known method for purifying an effervescent wine is known as methode champenoise. In such a process, temporary caps are installed on a specially constructed bottle of the unpurifyed wine. The bottles include an elongated, frangible neck portion, so that the bottles can be inverted to permit sediment to settle in the neck of the bottle. Once the sediment has settled, the neck is frozen and the frangible portion is removed from the remainder of the bottle so that the sediment can be discarded and only purifyed wine remains in the bottle. Such an operation is labor intensive and requires a substantial amount of apparatus for the installation of the temporary cap, freezing and discarding of the neck collected substance, and recapping of the bottles.

Another known process for removing the sediment from bottled wine is to decant the wine. Decanting is accomplished by allowing the sediment to settle in the bottle, and then pouring a substantial portion of the contents of the bottle into another container. A certain portion of the wine is retained in the bottle together with the sediment so as not to force the sediment to flow into the container. In such a process, care must be taken to avoid the stirring of the particles of sediment so that they do not flow off with the decanted portion of the wine. In addition, a substantial portion of the wine may remain with the sediment in order to avoid forcing particles of sediment into the decanted liquid.

In addition, other types of wines can be clarified by the distillation process, in which the wine is first vaporized by heating so that impurities are removed from the vaporized liquid and then cooled so that the vapor condenses to a purified liquid. Such a method requires a substantial amount of apparatus through which the wine must be processed before it can be bottled. Moreover, such a process is very time consuming and substantially increases the cost of producing the wine.

SUMMARY OF THE PRESENT INVENTION

The present invention overcomes the above mentioned disadvantages by providing a closure cap having a hollow chamber communicating at one end with the interior of the bottle and the means for selectively closing or opening the end of the chamber. Thus, the cap permits the bottle to be inverted to permit sediment to settle and accumulate within the chamber of the cap, and the chamber's end is then closed to avoid intermixing of the sediment with the clarified liquid in the bottle. When the cap has been removed from the bottle, the cap can be emptied cleaned and reused for sealing on another bottle, or can be discarded with the sediment if desired. Alternatively, an additive can be stored in the cap, and the valve opened when mixing of the additive with the contents of the bottle is desired.

The closure cap generally comprises a tubular housing adapted to engage against and seal the open neck of the bottle. A valve seat is formed around an aperature at one end of the housing enabling the chamber in the tubular housing to communicate with the interior of the bottle. A valve is displacable against the valve seat to close the valve when desired. The other end of the housing is closed so that the cap completely closes the neck and forms a tight seal for the bottle.

In the preferred embodiment, a plug is displaceably, but sealingly engaged in the other end of the housing. The plug includes an elongated stem having a valve formed on the free end. Preferrably, the valve seat includes tapering walls which taper inwardly toward the plug so that the settling sediment is directed into the chamber of the tubular housing. The plug extends outwardly from the end of the tubular housing so that it is accessible for engagement by a tool which permits the plug to be screwed into the housing to lock the valve against the valve seat. Once the valve has been closed, the cap can remain in place in the bottle to continue sealing the bottle while the bottle is stored.

In addition, the plug preferably includes a passageway to permit introduction of chemical additives or sweeteners to the wine contained in the bottle. The passageway is normally closed by resiliently urging the peripheral walls of the passageway into compression so that the cap continues to seal the contents of the bottle from the ambient air while the bottle is being stored. Nevertheless, the needle of a syringe can be introduced through the passageway so that the additives can be injected into the bottle.

Thus the present invention provides a means for sealing a wine bottle as well as simply and inexpensively separating sediment from clarified wine contained in the bottle. Moreover, once the sediment has been captured in the closure cap, the cap continues to seal the bottle. Nevertheless, additives can be introduced into the bottle without breaking the seal so that the aging process can be controlled as desired. When the cap is removed, it can be cleaned and reused or it can be discarded along with the sediment as desired. These and other advantages of the present invention will be more clearly described in the following detailed description.

BRIEF DESCRIPTION OF THE DRAWING

The present invention will be more clearly understood by reference to the following detailed description of the preferred embodiment of the present invention when read in conjunction with the accompanying drawing in which like reference characters refer to like parts throughout the views and in which:

FIG. 4 is an enlarged sectional view of the apparatus shown in FIGS. 1–3;

FIG. 5 is a sectional view taken substantially along the line 5—5 in FIG. 4;

FIG. 6 is a top plan view of the cap according to the present invention but showing a modification thereof;

FIG. 7 is an enlarged sectional view similar to FIG. 4 but showing another advantage of the present invention;

FIG. 8 is a fragmentary top plan view of the cap shown in FIGS. 2 and 3.

DETAILED DESCRIPTION OF THE PREFERRED EMBODIMENT

Figure 1:
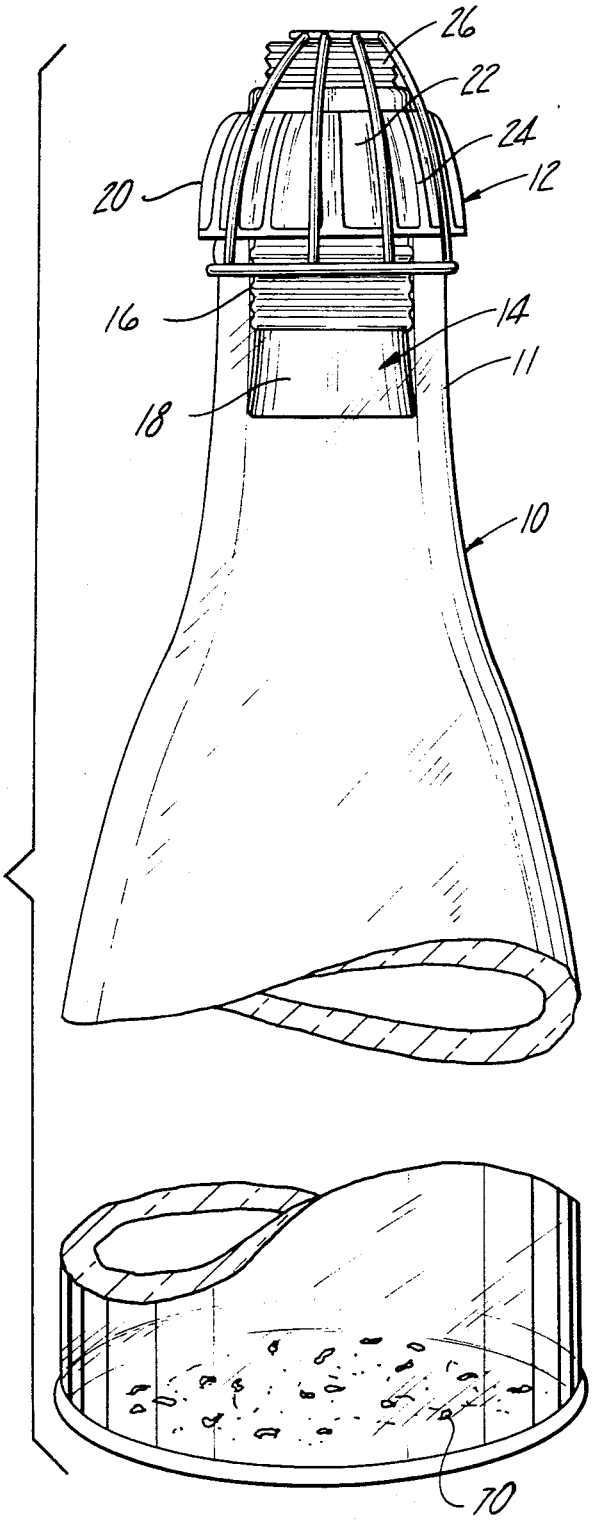
FIG. 1 is a broken, side plan view of a wine bottle including the closure cap according to the present invention.

Referring first to FIG. 1, a bottle 10 is thereshown sealed by a cap 12 according to the present invention. The cap includes an elongated tubular body housing 14 having peripheral means for engaging against and sealing the body housing 14 to the inner peripheral walls of the neck 11 of the bottle 10. As shown in FIG. 1, circumferential ribs 16 sealingly engage the interior of the neck 11. In addition, a flared end portion 18 resiliently engages the interior of the neck 11. Moreover, an expanded radial flange 20 covers and seals against the top of the neck 11 of the bottle 10. The flange 20 includes a plurality of grooves 22 defined by intermediate ribs 24 which are adapted to receive the strands of a wire harness for securing the cap 12 to the bottle 10. In addition, the ribs 24 permit the cap to be easily grasped for twisting and removing of the cap 12 from the bottle 10 when desired. A displacable plug 26 extends outwardly from the top of the cap 12 as will be described in greater detail hereinafter.

Figure 2:
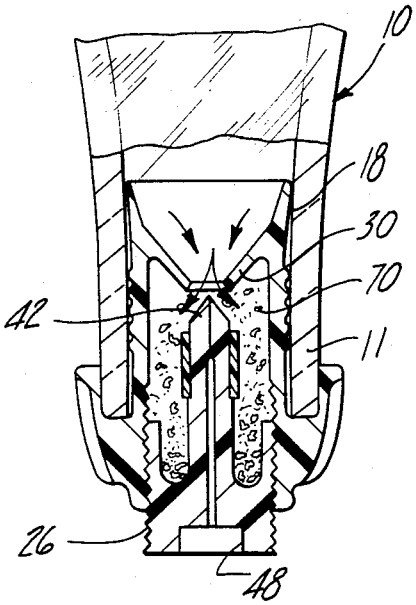
FIG. 2 is an inverted sectional view of the apparatus shown in FIG. 1.
Figure 3:
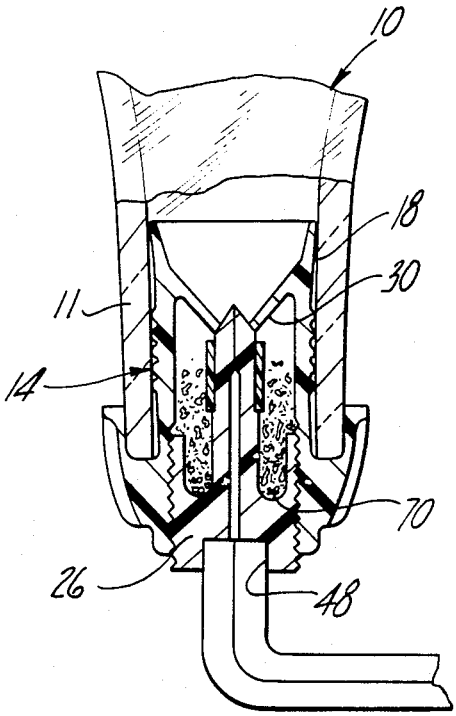
FIG. 3 is a sectional view similar to FIG. 2 but showing the closure cap in another operational position.

As best shown in FIGS. 2 through 4, the tubular body housing 14 defines a chamber 28 in the cap 12. The chamber 28 is closed at one end by a frusto-conical end wall 30 having an aperture 32. The end wall tapers inwardly toward the plug 26 which is threadably engaged within the other end of the housing 14. The aperture 32 provides fluid communication between the chamber 28 and the interior of the bottle 10. The periphery of the aperture 32 in the end wall 30 defines a valve seat 33 as will be discussed in greater detail hereinafter.

The plug 26 includes an elongated externally threaded portion 34 adapted to engage the correspondingly threaded top interior portion 35 of the housing 14. A smaller diameter stem 38 extends toward the end wall 30. The plug 26 can be provided with an annular recess 40 intermediate threaded portion 34 and the stem 38 to increase the capacity of the chamber 28 within the cap 12. The end of the stem 30 includes a conical protrusion 42 which forms a valve adapted to seat against the valve seat 33 on end wall 30. Registration of the valve 42 with the valve seat 33 permits displacement of the plug 26 to open and close the valve as desired.

As best shown in FIGS. 3 and 8, the top of the cap 26 includes a hexagonal recess 48 adapted to receive the end of an Allen wrench to permit the plug 26 to be rotated and thus screwed into and out of the housing 14. Although other types of means for inserting and removing the plug can be used, it will be understood that the hexagonal recess is simple to make and useful for turning the cap in both directions. Thus, such a recess is especially advantageous when the cap is to be emptied and reused on more than one bottle.

Alternatively, the plug 26 can be made so that it is rotatable only in a single direction. As shown in FIG. 6, a modification of the plug 26 is thereshown in which the recess includes tapering bottom walls 50. A flat wall surface 52 extends upward from the bottom of inclined wall 50 to form a land which can abut against a screwdriver given the cap is to be inserted by rotating the plug 26 in a clockwise direction. However, as the tool is rotated in the opposite direction the screwdriver blade slides up the inclined walls and prevents the plug 26 from being rotated in the counterclockwise direction. The lands 52 are separated an appropriate distance so that the screwdriver can be inserted therebetween.

Since the cap 12 must tightly seal the open end of the bottle, it will be understood that the plug 26 must be tightly sealed within the tubular body housing 14. In order to ensure tight engagement between the plug 26 and the housing 14, the major and minor diameters of the threaded portion 35 taper inwardly slightly toward the bottom of the threaded portion 35 about 0.005 of an inch so that the plug 26 becomes sealingly compressed within housing 14. Of course, it would also be possible to taper the threads outwardly on the upper part of the threaded portion 34 to provide a larger diameter threaded portion which tightly engages the interior of the housing portion 14 and prevents air from passing between the periphery of the plug 26 and the housing 14. However, in the preferred embodiment, reducing the thread diameters in the lower part of the female portion 35 also enables the plug to urge the housing 14 into tight engagement with the neck of the bottle. In addition, it will be understood that the seal between the plug 26 and the housing 14 is enhanced by the accumulation of sediment in the chamber 28 adjacent the interface of the plug 20 and the housing 14.

Referring now to FIGS. 5 and 7, the plug 26 includes a passageway 54 extending from the top of the plug 26 to the end of the end of the stem 38. The passageway 54 includes an enlarged diameter portion 56 in the top part of the plug 26 and a restricted portion 58 along the lower portion of the stem 38. An annular band 60 extends around the lower portion of the stem 38 so as to compress the stem about the restricted passage portion 58 and tightly close the passage as shown in FIG. 4. Nevertheless, a syringe needle 62 can be inserted through the upper portion 56 of the passageway 54 and wedged through the restricted portion 58 as shown in FIG. 7, so that the needle can communicate with the interior of the bottle 10.

Having thus described the important structural features of the present invention, the operation of the device is readily described with reference to FIGS. 2 and 3. The plug 26 is threaded into the housing 14 a short distance as shown in FIGS. 2 and 4 so that the conical projection 42 remains spaced apart from the valve seat 33. The housing 14 is then inserted into the neck of the bottle until the flange 20 overlaps the upper portion of the neck 11 of the bottle. In that position, the ribs 16 and the flared end portion of 18 tightly engage the interior of the bottle to seal the bottle. In addition, the flange 20 also serves as a seal and enables the cap to be grasped and twisted into or out of the bottle.

Once the cap has been installed, the bottle is inverted as shown in FIG. 2 so that the sediment 70 settles upon the end wall 30 in the cap. The bottle of wine is riddled by rotating it at repeated, spaced apart intervals so that the sediment is slightly agitated just enough to come free of the walls of the bottle and the end wall 30 of the cap and fall into the chamber 28.

Once the sediment has been completely removed from the sides of the bottle and the surface of the wall 30, the chamber 28 is closed as shown in FIG. 3. The Allen wrench is inserted into the recess in the top of the cap and rotated in a clockwise direction so that the conical protrusion or valve 42 seats against the valve seat 33 in the end wall 30. Thus, the sediment 70 remains entrapped within the chamber 28. It will also be understood that the bottle remains sealed and that the wine can continue to be aged if desired. In addition, it will be understood that additives can be introduced to the wine through the passage 54. The bottle cap can also be fixedly secured by applying a wire harness over the cap 12 and twisting the harness closed in a well known manner, without inhibiting the functions of this cap.

Thus the present invention provides the bottle closure which tightly seals wine or other beverage within a bottle and which permits the beverage to be clarified while it remains sealed in the bottle. Moreover, the cap permits additives to be added to the wine even after the bottle has been sealed. Furthermore, the cap can be reused or discarded as desired. Although it is preferrable that the cap housing be made of plastic material if it is intended to be reused so that it can be sterilized, it will be understood that other materials can be used to form the bottle cap in accordance with the present invention. In particular, it is also within the scope of the present invention to make the housing with cork so that the desirable characteristics of previously known cork closures can be realized. Moreover, the present invention provides a simple and efficient method of removing the sediment from bottled wine before the wine is consumed.

Alternatively, it will be understood that the cap can also be used to store additives for a bottled preparation, such as a medicinal solution. In that case, the valve is normally closed until the time that it is desired to mix the additive with the solution. Once the valve is opened, the additive is mixed with the solution to form, for example, an active compound. Thus, the cap is also useful for preserving the shelf-life of preparations to be stored in a bottle.

Having thus described my invention, many modifications thereto will become apparent to those skilled in the art to which it pertains without departing from the scope and spirit of the present invention as defined in the appended claims.

What is claimed is:

1. A closure for closing the neck of a bottle comprising:

a tubular housing defining a chamber having one end open for fluid communication with the interior of the bottle;

first means for selectively closing said one end of said chamber;

second means for closing the other end of said chamber; and third means on said housing for sealing the housing against the neck of said bottle to seal the bottle.

2. The invention as defined in claim 1 wherein said housing includes an aperatured end wall at said one end, said end wall defining a valve seat, and wherein said first means comprises a valve and fourth means for selectively displacing said valve with respect to said valve seat.

3. The invention as defined in claim 2 wherein said end wall tapers inwardly toward said other end of said housing.

4. The invention as defined in claim 2 wherein said fourth means comprises fifth means disposed at said other end of said housing for manually actuating said valve, whereby said fifth means is accessible exteriorly of said housing.

5. The invention as defined in claim 3 wherein said second means comprises a plug having means for displaceably engaging said plug in said other end of said housing, and wherein said plug includes an elongated stem extending into said chamber, and wherein said valve is formed on the free end of said stem.

6. The invention as defined in claim 5 wherein said valve comprises a conical projection on said stem.

7. The invention as defined in claim 5 wherein said plug and said other end of said housing are correspondingly threaded.

8. The invention as defined in claim 7 wherein a portion of said corresponding threads on at least one of said plugs and said other end are tapered toward the other of said plugs and said other end.

9. The invention as defined in claim 4 wherein said fifth means comprises said second means, and wherein said second means comprises a plug and sixth means for securing said valve to said plug.

10. The invention as defined in claim 9 wherein said plug is externally threaded and said other end of said housing includes internal corresponding threads, and wherein said plug includes externally accessible seventh means for manually rotating said plug.

11. The invention as defined in claim 10 and further comprising eighth means for restricting manual rotation of said plug to rotation in the direction which displaces said plug and said valve toward the valve seat.

12. The invention as defined in claim 1 wherein said third means comprises a flared end portion of said housing resiliently biased outwardly.

13. The invention as defined in claim 1 wherein said first means comprises means for selectively closing and opening said one end of said chamber.

14. The invention as defined in claim 1 wherein said other end of said housing includes a radially expanded flange portion coaxial with said tubular housing and having an annular recess adapted to receive the top of the bottle neck.

15. The invention as defined in claim 14 wherein said radially expanded flange includes a plurality of axially aligned grooves adapted to receive the wire strands of a wire harness.

16. The invention as defined in claim 1 wherein said closure includes a passage means for introducing additives to the wine bottle without removing the cap and means for normally closing said passage means.

17. The invention as defined in claim 16 wherein said passage means is formed in said second means.

18. The invention as defined in claim 4 wherein said plug includes an aperature extending through said plug in fluid communication with said open end and resilient means for normally closing said passage means.

19. The invention as defined in claim 18 wherein said resilient means comprises an annular ring compressed around said stem.

20. A method for separating sediment from the liquid in a bottle having an open top comprising:

installing a closure cap having a chamber communicating at one end with the interior of the bottle;

inverting the bottle so that sediment settles in the chamber of said closure cap;

closing said one end of said chamber.

21. The invention as defined in claim 20 and further comprising the step of riddling said bottle intermediate said inverting step and closing step.

22. The invention as defined in claim 20 and further comprising the step of introducing an additive to the liquid through said cap.

* * * * *